US009650118B2

(12) United States Patent
Kvyatkovskyy

(10) Patent No.: US 9,650,118 B2
(45) Date of Patent: May 16, 2017

(54) UNDERWATER TRANSPORT MODULE

(71) Applicant: Vladyslav Stanislavovych Kvyatkovskyy, Dnepropetrovsk (UA)

(72) Inventor: Vladyslav Stanislavovych Kvyatkovskyy, Dnepropetrovsk (UA)

( * ) Notice: Subject to any disclaimer, the term of this patent is extended or adjusted under 35 U.S.C. 154(b) by 0 days.

(21) Appl. No.: 15/125,198

(22) PCT Filed: Apr. 30, 2014

(86) PCT No.: PCT/UA2014/000046

§ 371 (c)(1),
(2) Date: Sep. 12, 2016

(87) PCT Pub. No.: WO2015/152853

PCT Pub. Date: Oct. 8, 2015

(65) Prior Publication Data

US 2017/0096207 A1 Apr. 6, 2017

(30) Foreign Application Priority Data

Mar. 31, 2014 (UA) ..... A201403103

(51) Int. Cl.

| | |
|---|---|
| ***B63G 8/22*** | (2006.01) |
| ***B63G 8/00*** | (2006.01) |
| ***B63G 8/08*** | (2006.01) |

(52) U.S. Cl.

CPC ..... *B63G 8/22* (2013.01); *B63G 8/001* (2013.01); *B63G 8/08* (2013.01); *B63G 2008/004* (2013.01)

(58) Field of Classification Search

CPC ..... B63G 8/22; B63G 8/08; B63G 8/001

See application file for complete search history.

(56) References Cited

U.S. PATENT DOCUMENTS 3,572,129 A * 3/1971 Walthier et al. ..... E21O 50/00 37/187

3,731,975 A * 5/1973 Lindelof ..... E02F 5/006 299/8

(Continued)

*Primary Examiner* — Stephen Avila

(74) *Attorney, Agent, or Firm* — Inventa Capital PLC

(57) ABSTRACT

This invention relates to deep-water underwater transportation in mining operations, and can be used for the placement of geological survey and mining equipment. The present underwater transport module comprises a body (1), ballast tanks (2) with adjustable buoyancy, and a system (3) for pumping a working medium in and out, said working medium being water from outside the transport module. According to the invention, the body (1) has a streamlined shape and is made of syntactic foam (a composite based on hollow glass microspheres), the ballast tanks (2) are configured in the form of a multi-tiered ballast system comprised of a plurality of spherical vessels (4), each of which consists of two interconnected hemispheres (5), the cavities (6) of the spherical vessels (4) being connected to one another and to the system (3) for pumping a working medium in and out, and the underwater transport module further comprises hydraulic propellers (7) for cruising and maneuvering, said propellers being connected to the system (3) for pumping a working medium in and out. The invention provides for the reliable and environmentally friendly use of a transport module at great depths as a result of enhanced durability, buoyancy and maneuverability.

9 Claims, 6 Drawing Sheets

(56) References Cited

U.S. PATENT DOCUMENTS

| | | | | |
|---|---|---|---|---|
| 3,949,694 | A * | 4/1976 | Bastide | B63C 11/42 114/313 |
| 2006/0228960 | A1* | 10/2006 | Durling | B63B 3/13 440/88 F |
| 2008/0264323 | A1* | 10/2008 | Gosling | B63G 8/08 114/330 |
| 2013/0106105 | A1* | 5/2013 | Dehlsen | F03B 17/061 290/43 |
| 2014/0081504 | A1* | 3/2014 | Smith | B63B 59/10 701/23 |
| 2014/0272475 | A1* | 9/2014 | Morash | B22D 31/00 429/6 |
| 2015/0136012 | A1* | 5/2015 | Williams | B63G 8/001 114/312 |

* cited by examiner

UNDERWATER TRANSPORT MODULE

RELATED APPLICATIONS

This application claims priority to PCT/UA2014/000046 filed on Apr. 30, 2014 and Ukrainian application number a201403103 filed on Mar. 31, 2014 and incorporated herewith by reference in its entirety.

FIELD OF THE INVENTION

This invention relates to deep-water underwater transportation in mining operations, and can be used for the placement of geological survey and mining equipment.

BACKGROUND OF THE INVENTION

The basic requirements to geological survey and mining technologies are reliability and minimal environmental damage caused by conveyance of near-bottom mineralized waters with silt to the surface in the course of extraction of minerals and as a result of dumping the mining refuse to the near-surface ocean. Any production unit designated for collection of ferromanganese nodules shall comply with the following requirements: bottom areas handling at the speed of 10 . . . 15 sq.m./sec.; no-failure movement and operation in case of any undetected obstructions within the nodules collection site.

In order to ensure effective collection of ferromanganese nodules using computer-aided procedures, the average speed of the collecting unit should not exceed 0.5 m/sec., and the unit body should move at the level of 5 meters above the ocean bottom. The facilities for placement of exploration and extraction equipment are known in the prior art, including: "FREE-FALL BOTTOM SAMPLER"0 U.S. Pat. No. 3,572,129 (A) (BEAR CREEK MINING CO) Mar. 23, 1971; "MODULE AND PROCESS FOR UNDERWATER MINING OF MINERAL BEARING SAND AND GRAVEL" U.S. Pat. No. 3,731,975 (A) (QVA CORP, US) Jul. 8, 1973[6].

The known facilities are heavier and lack strength and resistance, meaning that they can be used at great depth (about 6,000 meters) to a limited extent. The most similar in function underwater transport module comprising a body, ballast tanks with adjustable buoyancy, and a system for pumping a working medium (i.e. overboard water) in and out ["Subsea Platform" RU2182212 (C2) (May 10, 2002] is already known in the prior art.

The module frame is made from arched structure elements in a shape of a truncated triangular pyramid, and the V-shaped support beams are mounted rigidly to the frame, while foamed polyurethane blocks are mounted at the top of the frame for buoyancy purposes. The ballast tanks of the module are configured in the form of a torus-shaped floating hull and pipe sections. A disadvantage of the previously known unit is its insufficient strength, buoyancy and maneuverability; thus it cannot be used at great depth (6,000 m).

SUMMARY OF THE INVENTION

This invention is focused on the following objective: to design and build an underwater transport module that can be used at great depth in a safe, reliable and environmentally friendly manner by virtue of its improved strength, buoyancy and maneuverability. This engineering challenge shall be solved as follows: the underwater transport module, comprising a body, ballast tanks with adjustable buoyancy and a system for pumping a working medium in and out, said working medium being water from outside the transport module shall contain, according to the invention, the body having a streamlined shape and made of syntactic foam (a composite based on hollow glass microspheres), ballast tanks configured in the form of a multi-tiered ballast system comprised of a plurality of spherical vessels, each of which consists of two interconnected hemispheres, the cavities of the spherical vessels being connected to one another and to the system for pumping a working medium in and out, and the underwater transport module further comprises hydraulic propellers for cruising and maneuvering, said propellers being connected to the system for pumping a working medium in and out.

The optimal weight—strength—buoyancy—maneuverability ratio was reached as a result of the following: the body is made of the syntactic material, the ballast tanks form the multi-tiered ballast system comprising a series of spherical vessels, each of which consists of two interconnected hemispheres, and the cavities of the spherical vessels are connected to one another and to the system for pumping a working medium in and out.

The hydraulic propellers for cruising and maneuvering, connected to the system for pumping a working medium in and out, support the movement and maneuvering of the underwater transport module while carrying out various technological operations at the given depth and zero buoyancy, for example, 5 meters over the bottom, thus mitigating the adverse environmental impact of the technological processes.

The claimed design of the underwater transport module is characterized by an optimal weight—strength—buoyancy—maneuverability ratio, making it possible to conduct various technological processes at great depth (6,000 m) without any harm or damage to the environment. The underwater transport module has additional distinctive parameters which improve or increase technical results.

The fact that the body is made as one piece or assembled of individual units made from the syntactic material, with the density not exceeding $\rho$=700 kg/c.m. and with the compressive strength of at least $\sigma$=90 MPa, being the composite based on a binding agent—polyester resins with a filler (hollow glass microspheres 0.01-10.0 micrometers in size), as well as that the hemispheres are made from steel with the yield point of at least 1,200 MPa, guarantees high strength and proper buoyancy of the underwater transport module.

The fact that the hemispheres of spherical vessels have flanges and portholes in walls with the axes located at an angle of $\alpha$=90° to each other and where the threaded bushings are fixed, and that these hemispheres are interconnected with flanges and connected by bolt joints, makes it possible to install the entire system promptly in the course of its manufacturing. In the underwater transport module, the adjacent spherical vessels are connected to one another with the hollow threaded ties. The spherical vessels form a "honeycomb-type" multi-tiered ballast system. Such solution decreases working hours and manpower efforts for the system installation and dismantling and improves its maintainability.

In the underwater transport module, the multi-tiered ballast system is filled with a syntactic material, and, in conjunction with the body, it forms a one-piece unit. Such layout ensures convenience of ballast system installation within the body. The underwater transport module may additionally comprise a mounted changeable work tool with a drive, receiving and collecting bunkers connected to one another with a screw conveyor, and a discharge device.

The system for pumping a working medium in and out additionally comprises a high pressure pump with the drive, the drive of the changeable work tool configured in the form of a hydroturbine, hydraulically connected to the system for pumping a working medium in and out from the "honeycomb-type" multi-tiered system, a system of autonomous mobile power-generating units and an autonomous urgent emersion system. Such solution is characterized by improved reliability and reduced time for the replacement of power-generating units and technical maintenance of the equipment.

Such improvement allows installing, onboard the underwater transport module, an effective extraction vehicle for collection of minerals with the mobile power supply systems and autonomous urgent emersion system in case of emergency.

BRIEF DESCRIPTION OF THE DRAWINGS

Further on, you will find a detailed description and explanation of the invention, together with references to drawings and layouts, where.

DESCRIPTION OF PREFERRED EMBODIMENT

Figure 2:
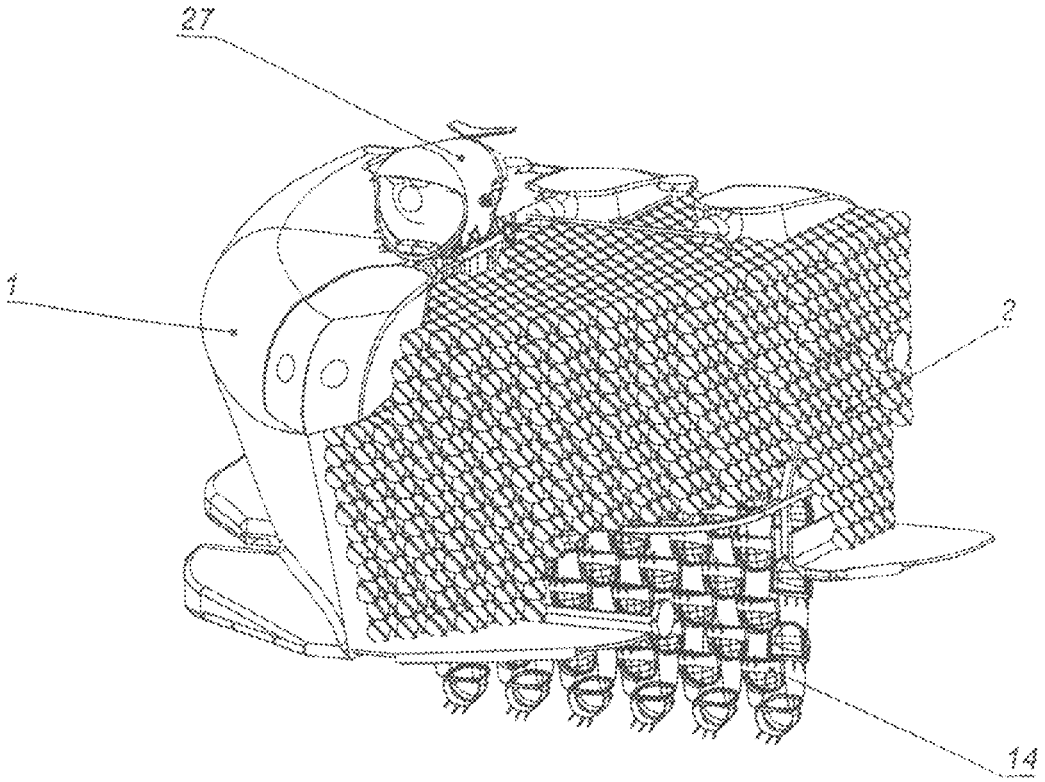
FIG. 2 illustrates the underwater transport module with an underwater manned vehicle.
Figure 3:
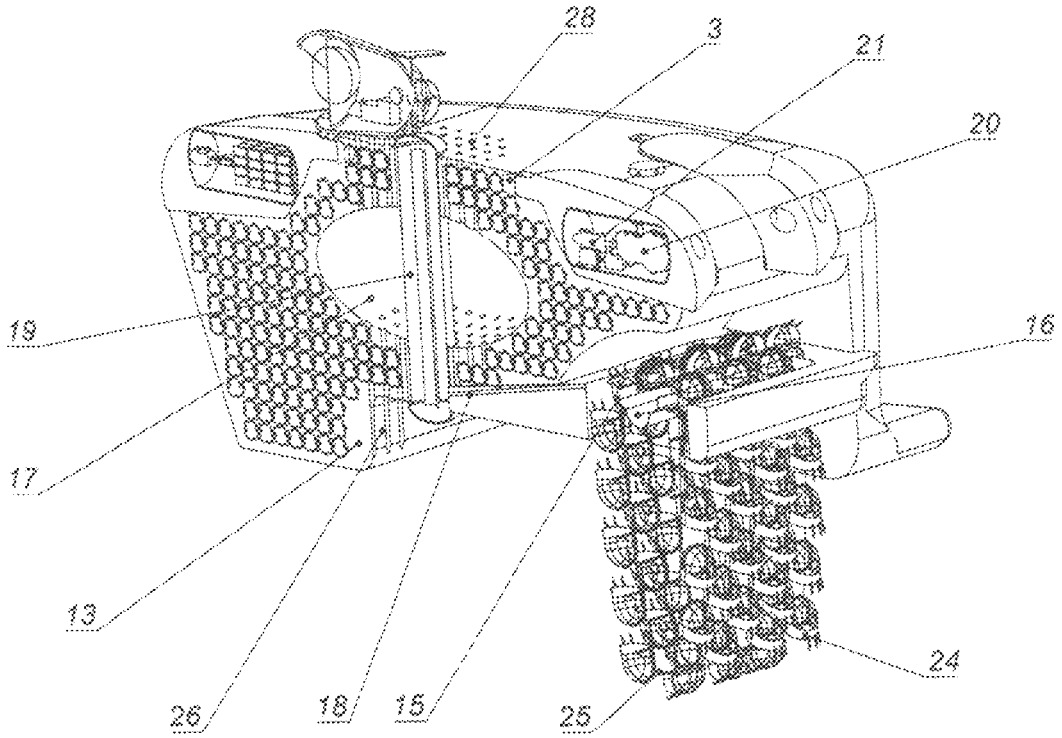
FIG. 3 illustrates a longitudinal section of the underwater transport module.
Figure 4:
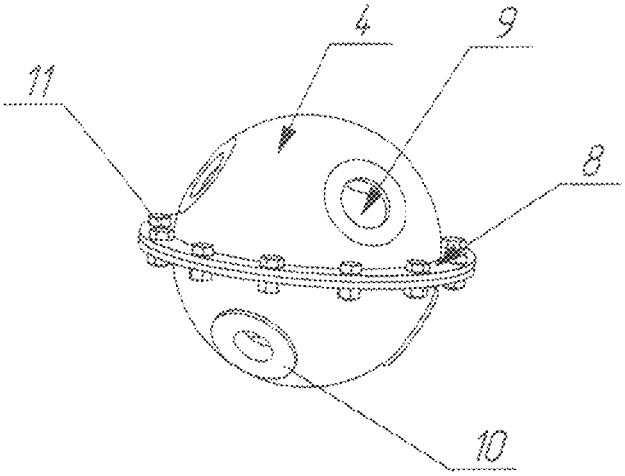
FIG. 4 illustrates a spherical tank of the multi-tiered ballast system.
Figure 5:
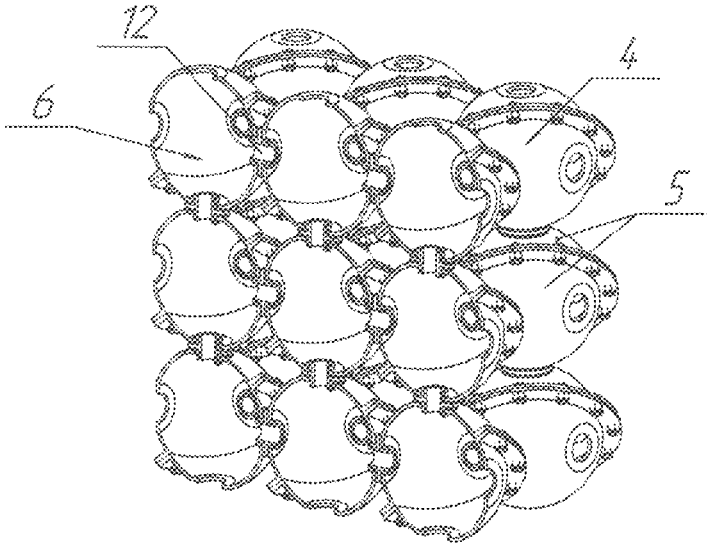
FIG. 5 illustrates the multi-tiered ballast system.

The underwater transport module (FIG. 1) comprises the body 1, ballast tanks 2 (FIG. 2) in the form of the multi-tiered ballast system, and the system 3 for pumping a working medium in and out (FIG. 3). The multi-tiered ballast system consists of a number of spherical vessels 4 (FIG. 4), each of which comprises two interconnected hemispheres 5 (FIG. 5), while the cavities 6 of the spherical vessels 4 within the multi-tiered ballast system are connected to one another and to the system 3 for pumping a working medium in and out, to ensure negative buoyancy for the module immersion or positive buoyancy for its emersion, or zero buoyancy in the course of immersion to the specified operating depth or for immersion depth stabilization in case the module weight varies.

The body 1 is streamlined and monolith or may be assembled of separate units and made of the syntactic material; and the hemispheres 5 of the spherical vessels 4 within the multi-tiered ballast system are made of steel with the yield point equal to or exceeding 1,200 MPa.

Hemispheres 5 of the spherical vessels 4 within the multi-tiered ballast system have flanges 8 (FIG. 4) and portholes 9 in walls with the axes located at an angle of $\alpha=90°$ to each other and the threaded bushings 10 fixed, and the hemispheres 5 are connected to one another with the flanges 8 and connected by bolt joints 11, and, as an assembly, form spherical vessels 4 within the multi-tiered ballast system.

The adjacent spherical vessels 4 within the multi-tiered ballast system are connected to one another with the hollow threaded ties 12 (FIG. 5), which connect them to the threaded bushings 10 of the hemisphere 5. The multi-tiered ballast system is filled with a composite syntactic material and, together with the body 1, forms the one-piece unit 13 (FIG. 3).

The module also comprises hydraulic propellers 7 for cruising and maneuvering (FIG. 1) connected to the system 3 for pumping a working medium in and out for the module movement and maneuvering purposes. According to the specifications above (modification 1), the underwater transport module is capable of carrying out transport and lifting operations at the depth of 6,000 meters.

For the extraction and handling of minerals (modification 2), the underwater transport module may be additionally equipped with one of the mounted changeable work tools 14 (FIG. 1) with the drive 15 of the mounted changeable tool (FIG. 6), receiving bunker 16 (FIG. 3), and collecting bunker 17, connected together by the screw conveyor 18, as well as the discharge device 19.

This modification makes it possible to carry out efficient collection of minerals such as ferromanganese nodules. The system 3 for pumping a working medium in and out also contains a high pressure pump 20 with a high pressure pump drive 21 (FIG. 3).

The drive 15 of the mounted changeable work tool 14 is implemented in the form of a hydroturbine hydraulically connected to the system 3 for pumping a working medium in and out.

Figure 1:
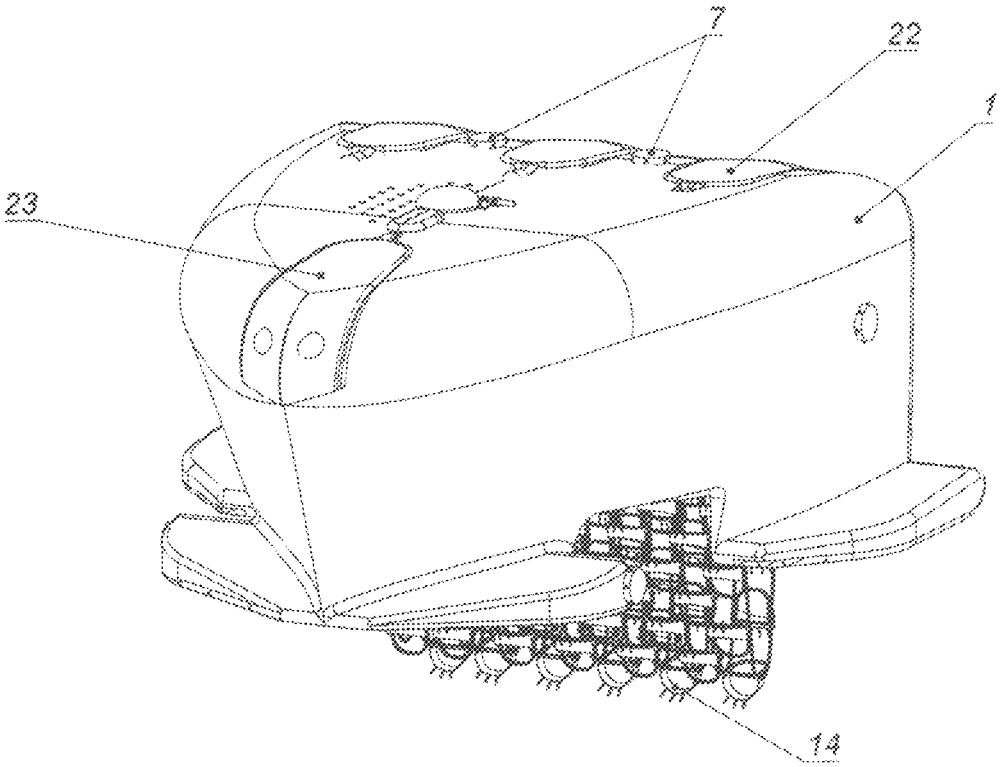
FIG. 1 illustrates the underwater transport module (general layout)

The underwater transport module may be equipped with the autonomous power supply system 22 and the urgent emersion system 23 (FIG. 1). The mounted changeable work tool 14 may be implemented in the form of a chain conveyor with ladles 24 and chains 25 (FIG. 3). The ladles 24 are gimbal-mounted to the chain 25 and adapted to flexible turning in case of contact with any obstruction in the course of the module movement, and capable of returning to the initial position.

The ladles 24 may be implemented as a series of chains connected together.

According to the above specifications (modification 2), the underwater transport module in the course of minerals development and in case of use of the mounted changeable work tool 14 has zero buoyancy and remains at the level of 5 meters above the bottom at the depth of 6,000 meters.

With the loading of the collecting bunker 17 and increasing the module weight, the system 3 for pumping a working medium in and out responds to all the changes, dewaters and maintains the operating location at the level of 5 meters over the ocean bottom.

Water-jet nozzles 26 (FIG. 3) are located at the bottom of the body 1. The underwater transport module may be accompanied with the underwater manned vehicle 27 (FIG. 2). The nodules storage bunker has collecting bunker portholes 28 (FIG. 3). The equipment operates as follows:

The module initial location is on the surface of the water area near the support vessel. In the course of unloading after the previous operating cycle, the high pressure pump 20 of the system 3 for pumping a working medium in and out within the multi-tiered ballast system shall be turned on. Upon the unloading completion and attainment of the specified negative buoyancy, the module shall start controlled and operated immersion to the bottom of the water area. The underwater transport module in modification 1 shall operate as a carrier of cargos or underwater facilities. The underwater transport module in modification 2 shall operate as an autonomous extraction module. Upon attainment of the specified immersion depth (5 meters above the bottom), the module shall be capable of moving and maneuvering while carrying out various technological operations at the specified depth and zero buoyancy.

The hydraulic propellers 7 for cruising and maneuvering ensure autonomous movement of the module along the trajectory within the certain pathway. Then, the drive 15 of the mounted changeable work tool 14 shall be automatically turned on to start collecting ferromanganese nodules into the receiving bunker 16 and carrying the same to the collecting bunker 17.

The chains 25 of the mounted changeable work tool 14 with ladles 24 shall move with respect to the body 1 using the regulated drive 15 of the mounted changeable work tool and, while hanging down, slide over the bottom.

The ladles 24 shall ladle out ferromanganese nodules together with the silt layer, and this silt shall run through lattice walls and bottom of the ladles 24, while the ferromanganese nodules shall be conveyed to the collecting bunker 17. The module designed according to the above specifications is capable of surmounting any juts of 1.5 . . . 2 m high, without suspending the ferromanganese nodules collection process; and the chains 25 with ladles 24 slide over the surface of such juts. Pits and clefts of any dimension shall not be treated as obstacles for the module movement, even if the base relief is quite rugged, since the ladles 24 are gimbal-mounted to the chain 25, making it possible to conduct a flexible turn in case of any contact with obstructions and to return to the initial position.

Figure 6:
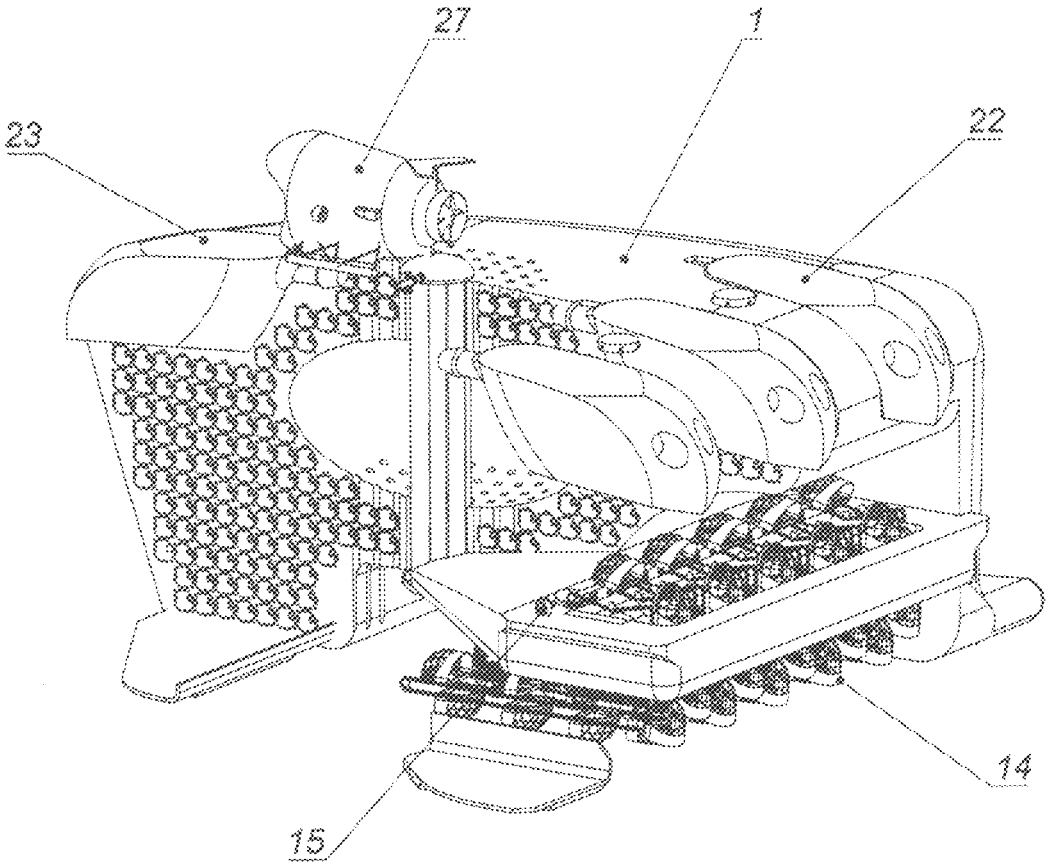
FIG. 6 illustrates the underwater transport module ready for nodules transportation.

The function of operational control over the chain 25 speed and the module location over the bottom makes it possible to control the speed of the underwater vehicle. In the course of the underwater transport module operation, the mounted changeable work tool 14 shall be in its operating position (FIG. 1), and while the underwater transport module is immersing or emerging the mounted changeable work tool 14 shall be in its transport position (FIG. 6).

The water-jet nozzles 26 mounted to the bottom of the body 1 make it possible to carry the biomass and benthic life (possibly found on the surface of ferromanganese nodules) away from the area where the development operations are conducted, by throwing the same to both sides of the chain ladles, thus mitigating the adverse environmental impact of such operations.

The operation of the underwater transport module may be controlled from two mobile control points. The first control point comprises the equipment for the underwater transport module operation: an interferometric hydrolocator with lateral visibility, a frontal echo sounder, a hydrolocator with all-round visibility and a multibeam one, as well as a profilograph. These systems are designated to collect the bottom characteristics data for the module movement control purposes. The navigation system may be equipped with an on-board satellite system and an underwater sound system. A balanced Doppler-inertial on-board system makes it possible to carry out the adjustment with the help of data from the Doppler log, where the module speed varies relative to the ground and water. These data shall allow maintaining the depth level required to carry out the extraction activities. A DPRS system is used for the above-water movement of the module. The acoustic navigation system allows identifying the module location relative to bottom beacons.

The second control point may be installed in the underwater transport module in order to fulfill any task with the use of videos from the module video cameras. At the upper side of the underwater transport module there may be a platform for various types of underwater manned vehicles 27 (whose operational depth is about 6,000 meters). The platform may be equipped with a data transmission system to transfer the data to the underwater manned vehicle 27, from where the module is operated manually with the help of a video image. The underwater manned vehicle 27 is capable of emerging together with the underwater transport module, or independently using the urgent emersion program.

The claimed underwater transport module prevents the movement of silt and bottom water to the surface, since the collecting bunker 17 has the collecting bunker portholes 28 through which (in the course of the underwater module emersion) the overboard water is released, thus providing continuous interchange and displacement of water layers during the emersion process.

The module is designated to collect ferromanganese nodules at the level of 3 . . . 5 meters over the bottom, depending on the bottom slant, using special chain-type ladles 24 that collect only ferromanganese nodules and downstock the nodules (undamaged) into the receiving bunker 16. After the module completes the task (i.e. the specified quantity of nodules is collected), the module emerges and subsequently gets unloaded at the support vessel. The autonomous power supply system 22 of the module may comprise three separate mobile units, each unit equipped with an engine, fuel tanks, a generator, a high pressure pump system, a steering system, and navigation equipment.

All elements of the power supply system are installed within a special container and covered with the composite syntactic material. All of them together form a one-piece unit with manholes for maintenance purposes. In case of failure of any of power-generating units, two other units can operate for urgent emersion of the underwater transport module, in case of breakdown of two power-generating units, the one remaining is capable of conducting urgent emersion of the underwater transport module. Against the possibility of failure of all power-generating units, the module is equipped with the autonomous urgent emersion system 23, comprising a set of accumulators and capable of pumping the water out of the ballast system to ensure the transport module positive buoyancy. The power-generating unit maintenance operations may be carried out by means of replacement of such units and their subsequent repair aboard the support vessel.

The design carrying capacity of the underwater transport module is 300 tons. A set of underwater transport modules (modification 2) may form a "production complex". Such production complex can comprise two ore carriers and two underwater transport modules (modification 2) being the autonomous production units. The use of the claimed invention is possible subject to construction of underwater transport modules with a carrying capacity of up to 1,000 tons.

INDUSTRIAL APPLICATION OF THE INVENTION

The given details prove a possibility of industrial application of the underwater transport module that (in modification 1) may be used (as a carrying unit) for underwater conveyance and placement of geological survey and mining equipment, or (in modification 2) for collection of nodules from the ocean bottom.

LIST OF DESIGNATIONS

1) body
2) ballast tanks 3) system for pumping a working medium in and out
4) spherical vessels
5) hemispheres
6) cavities of spherical vessels
7) hydraulic propellers for cruising and maneuvering
8) flanges of hemisphere spherical vessels
9) portholes in the hemisphere walls
10) threaded bushings
11) bolt joints
12) hollow threaded ties
13) one-piece unit
14) mounted changeable work tool
15) drive of the mounted changeable work tool
16) receiving bunker
17) collecting bunker
18) screw conveyor
19) discharge device
20) high pressure pump
21) high pressure pump drive
22) autonomous power supply system
23) urgent emersion system
24) ladle
25) chain
26) water-jet nozzle
27) underwater manned vehicle
28) collecting bunker portholes

The invention claimed is:

1. The underwater transport module, comprising a body (1), ballast tanks (2) with adjustable buoyancy and a system (3) for pumping a working medium in and out, said working medium being water from outside the transport module, characterized in that the body (1) has a streamlined shape and is made of syntactic foam, a composite based on hollow glass microspheres, ballast tanks (2) are configured in the form of a multi-tiered ballast system comprised of a plurality of spherical vessels (4), each of which consists of two interconnected hemispheres (5), the cavities (6) of the spherical vessels (4) being connected to one another and to the system (3) for pumping a working medium in and out, and the underwater transport module further comprises hydraulic propellers (7) for cruising and maneuvering, said propellers being connected to the system (3) for pumping a working medium in and out.

2. The underwater transport module as claimed in claim 1, wherein the body (1) is made of syntactic foam with the density not exceeding $\rho$=700 kg/c.m., and with the compressive strength of at least $\sigma$=90 MPa, and is a composite based on a binding agent—polyester resins with a filler, hollow glass microspheres of 0.01-10.0 micrometers, and hemispheres (5) are made of steel with the yield point of at least 1,200 MPa.

3. The underwater transport module as claimed in claim 2, wherein the hemispheres (5) of the spherical vessels have flanges (8) and portholes (9) in the hemisphere walls with the axes located at an angle of $\alpha$=90° to each other, where the threaded bushings (10) are fixed, and the hemispheres (5) are interconnected by the flanges (8) and bound by bolt joints (11).

4. The underwater transport module as claimed in claim 3, wherein the adjacent spherical vessels (4) are connected to one another with the hollow threaded ties (12).

5. The underwater transport module as claimed in claims 1, wherein the multi-tiered ballast system is filled with the syntactic foam and together with the body 1 is a monolithic unit (13).

6. The underwater transport module as claimed in claims 1, wherein it additionally comprises a mounted changeable work tool (14) with a drive (15), a receiving bunker (16) and a collecting bunker (17) connected to one another with a screw conveyor (18).

7. The underwater transport module as claimed in claim 6, wherein it additionally comprises a discharge device (19).

8. The underwater transport module as claimed in claim 1, wherein the system (3) for pumping a working medium in and out additionally comprises a high pressure pump (20) with a high pressure pump drive (21), with the drive (15) of the changeable work tool (14) configured in the form of a hydroturbine, hydraulically connected the system (3) for pumping a working medium in and out.

9. The underwater transport module as claimed in claim 1, wherein it additionally comprises an autonomous power supply system (22) and a system (23) of urgent emersion.

* * * * *